United States Patent [19]

Nagy et al.

[11] Patent Number: 4,531,074

[45] Date of Patent: Jul. 23, 1985

[54] ELECTRICAL CURRENT INLET PARTICULARLY FOR DISCHARGE TUBES OF HIGH PRESSURE DISCHARGE LIGHT SOURCES

[75] Inventors: János Nagy; Endre Oldal, both of Budapest, Hungary

[73] Assignee: Tungsram Rt., Budapest, Hungary

[21] Appl. No.: 470,683

[22] Filed: Feb. 22, 1983

[30] Foreign Application Priority Data

Feb. 25, 1982 [HU] Hungary ..... 570/82

[51] Int. Cl.[3] ..... H01J 5/50

[52] U.S. Cl. ..... 313/331; 313/623; 313/333; 174/50.52; 174/50.64

[58] Field of Search ..... 174/50.52, 50.61, 50.64, 174/72 R, 128 BL; 313/623, 331, 332, 333, 620

[56] References Cited

U.S. PATENT DOCUMENTS

| | | | |
|---|---|---|---|
| 1,608,799 | 11/1926 | Marschner | 313/623 |
| 1,834,132 | 12/1931 | Miller | 313/333 |
| 4,376,905 | 3/1983 | Kerekes | 313/623 |

*Primary Examiner*—Saxfield Chatmon
*Attorney, Agent, or Firm*—Gabriel P. Katona

[57] ABSTRACT

Electrical current supply terminal, especially for discharge tubes of light sources having a high pressure gas discharge.

The invention is concerned with an electrical feed through, especially for discharge tubes of light sources having high pressure gas discharge, which current supply terminal is passed through a ceramic material, preferably from aluminum oxide and with a binding material is hermetically binded thereto, the heat expansion coefficient of which is appropriately selected and which is preferably vitreous enamel.

In order to eliminate the difficulties resulting from the different heat expansion coefficient of ceramics, binding material and the metal material, the feed through is formed from a bundle of metallic threads.

The bundle comprises preferably strands or braids and as material preferably molybdenum or tungsten is used.

10 Claims, 1 Drawing Figure

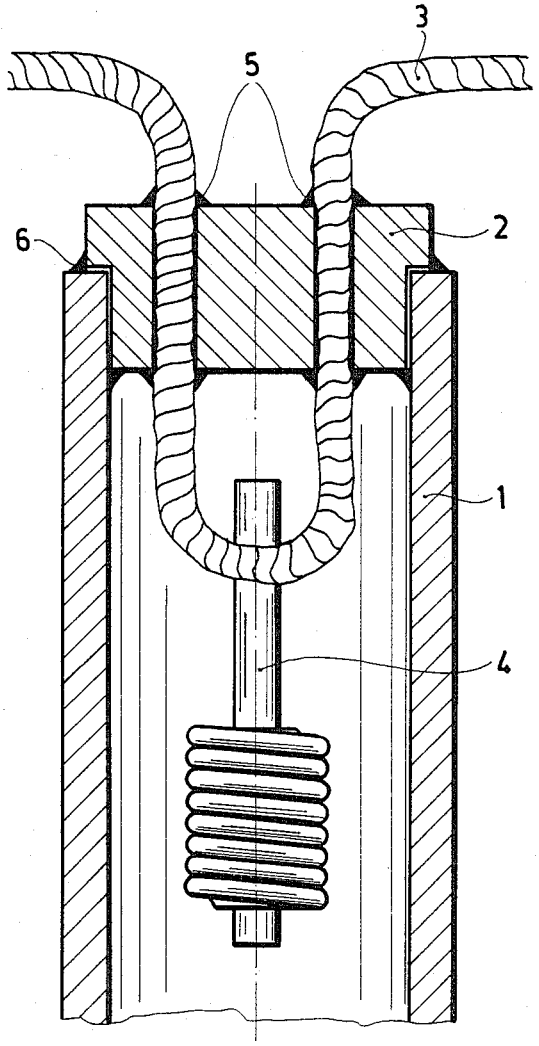
3
5
6
2
1
4

ELECTRICAL CURRENT INLET PARTICULARLY FOR DISCHARGE TUBES OF HIGH PRESSURE DISCHARGE LIGHT SOURCES

The invention relates to the supply current terminal particularly for the discharge tubes of high pressure gas discharge light sources, wherein the supply current is fed preferably through ceramic material comprising aluminum oxide and, in which, a binding material, preferably vitreous enamel having an appropriately selected heat expansion coefficient, will provide the hermetic binding.

From the technical viewpoint it is an important, however, it is a very difficult to be solved object, to supply the current through a material comprising a pure aluminum oxide in a manner, that the current supply should create a vacuum type seal and, at the same time, should be operable at a high temperature.

This question became especially significant since light sources with high pressure gas discharge became known, which possess very advantgeous light technical properties (mainly concerning the light output) which, however, are operated in their discharge tube with a filling having an aggressive nature, consequently, as a material of the necessarily light transparent discharge tube only aluminum oxide has proved itself in practice. The most characteristic representative of such gas discharge light sources is the sodium vapor high pressure lamp.

In the realization of such feed through difficulties are created in that temperature of the ceramic material and of the supply current terminal which during the manufacturing and during the operation will assume a value of 1,400–1,500 C. starting from the surrounding temperature and, under such conditions the difference between the heat expansion coefficient of the metallic and ceramic material of the supply current terminal will lead to thermal tensions and, consequently to cracks leading eventually to the destruction of the discharge tube and thereby of the entire lamp.

In the heretofore known solutions for the of similar art, one made use of the circumstance that the heat expansion coefficient of Niobium within wide temperature limits is approximately the same as that of the aluminum. In such constuctions Niobium is present as the material of the current supply terminal which is melted to the aluminum oxide with a certain vitreous enamel, wherein the aluminum oxide similar heat expansion coefficient possesses. Such solution is widely distributed in different varieties, it is, however, possessing certain disadvantages. The most important of then is the high price of the Niobium.

A further disadvantage of Niobium resides in that it is a very sensitive material which even in the presence of a very small amount of impurity becomes hard and brittle. A further disadvantage of the Niobium resides in that it has a high permeability regarding several gases, and as a result, the varying effects of the inner and outer gas volume of the discharge tube adversely effect the stability and the life expectancy of the lamp. In order to partially prevent such influence, as it became known from U.S. Pat. No. 3,485,343, into the pipe-shaped Niobium current terminal an Yttrium getter is placed. Such method is, however, not effective for each gas (for example, not for hydrogen) and it further contributes to the high costs.

A number of various attempts became known for the construction of such feed through which enable to avoid the use of Niobium. Among this, one of the first, should be mentioned the structure available from Hungarian Pat. No. 159,714, in which a plug made from aluminum oxide is sealed into the end of the aluminum oxide tube forming the discharge tube and the upper surface of which is covered prior with metal coating. The thickness of the metal coating and the circumstance that materials having similar heat expansion are used on both sides, makes it possible that the structure of the feed through meets the requirements.

Such construction proved itself very well in practice, however, as a disadvantage one may mention, that the manufacturing of the metal coated ceramic plug itself requires too much work input and, on the other side, further structural problems arise in connection with the electrical connection to the current supply within and outside of the discharge tube.

According to U.S. Pat. No. 3,659,138 a molybdenum wire having a diameter up to 0.5 mm can be directly sealed into an appropriately constructed ceramic material from aluminum oxide if the so called wetting angle will not be more than 30° between the vitreous enamel used for the sealing and the molybdenum. Such latter requirement can be solved in the practice with all types of vitreous enamel, however, in connection with some experiments by us, the results of the patent could not be reproduced, in each case, cracks appeared.

BRD Pat. No. DE-OS 2,032,277 proposes the use of a multi-layered vitreous enamel, similar to the so called transgressing glass metal-glass-seal (graded seal), the heat expansion coefficient of which consideably increases in the direction outwardly from the feed through consisting of molybdenum or tungsten wire. Such structure is theoretically sound, however, its practical embodiment is rather complicated.

The basic principle of U.S. Pat. No. 3,848,151 is similar to that of the Hungarian patent, with the exception that between the ceramic plug and the ceramic tube no metal layer is provided on the plug but tin molybdeum foils are used, which to a certain extent represents a very work intensive and complicated approach.

Lastly, U.S. Pat. No. 4,001,625 is mentioned, which, in order to provide an elastic deformation, discloses a molybdenum tube, which separates a sintered member from Cermet from the surrounding aluminum oxide tube, the heat expansion coefficient of which lies between that of the molybdenum and of the aluminum oxide.

The Cermet materials are, as generally known, produced in a complicated and work intensive manner which is very difficult to reproduce and, in addition, such structure possesses the disadvantage that the discharge tubes with such current supply terminals will have a very limited life expectancy.

The object of our invention is the construction of such feed through, which does not possess the disadvantages of the heretofore known and above described solutions, and furthermore, the provision of a light source having high pressure gas discharge, the discharge tube of which has a current supply terminal of such improved characteristics.

Our invention rests on the recognition that the thermal expansions are caused by the fact that there is a difference between the heat expansion coefficient of the metal material of the current supply terminal on one hand and, on the other hand, between the ceramics and of the bonding material and, it can be lowered to any desirable value so far the diameter of the metallic current supply terminal becomes sufficiently small. According to our invention one will arrive at the set objective by making use of the circumstance that instead of using a feed through made from a full metal, it is replaced by a bundle of metallic threads having a relatively small diameter.

It is preferred for operational reasons that the invention is performed with the metallic threads being twisted or braided.

It is also possible to use strands or braids with double strands or braids.

According to our experiments, the requirements for the structure of a reliable feed through resides in that the diameter of the elementary metal threads bunched together into a bundle should not exceed a certain value which depends from the material of the used metal having a very high melting point (preferrably molybdenum, molybdenum alloy, tungsten, tungsten alloy).

Such diameter in the case of molybdenum corresponds to 0.15 mm, with tungsten it is 0.1 mm. In order to increase the reliability, it is preferred in the case of molybdenum to select a diameter for the elementary metal threads not higher than 0.01 mm, for tungsten, not higher than 0.6 mm.

The lower limit of the diameter is according to desire, however, the manufacturing costs of the metallic threads having smaller diameters than 0.01 mm are generally high, so that the economy of the investment involved should be questioned.

The number of the elementary metal threads lying electrically parallel within the bundle, can be selected freely and corresponding to the structural requirements, however, one should consider the effects caused by the joulan heat resulting from the current flowing through the supply current input and, on the other hand, the cooling questions connected with the conducting away of the heat.

The advantages of the solution of our invention reside also in that the thermal tensions between the metal material of the supply current terminal and of a ceramics, preferably aluminum oxide and the binding material, preferably vitreous enamel, are reduced such tensions could lead to waste formation. A further additional advantage of our invention with respect to the supply current terminals having the conventional Niobium structure, resides also in that the sensitivity of the other metals, in the present case, the molybdenum and of the tungsten with respect to the Niobium, is much smaller, with respect to the impurities, and also the permeability with respect to the various gases is much smaller, and such circumstance considerably eliminates the variations between the inner and outer gas space of the discharge tube.

Our invention will be described in more detail on hand of the exemplary embodiment according to FIG. 1.

FIG. 1 represents a partial view in section of the discharge tube of a sodium vapor high pressure lamp.

In our example the discharge tube of a sodium high pressure lamp having a output of 250 w and an operating voltage of 100 V, is shown.

The envelope 1 at the wall of the discharge tube comprises a transparent (polycrystalline) or a translucent (single crystalline) aluminum oxide, into one end of which an aluminum plug 2 is fitted. Through its bores of 0.5 mm in diameter, the supply strand 3 is threaded or passed through, as this can be seen in the figure.

The strand is made as follows:

First the strand is made from molybdenum wires having a diameter of 0.05 mm and particularly from two elementary metallic wires. Thereafter from 15 of such strands, a secondary strand is prepared. In the supply terminal strand 3 which is already passed through, the tungsten shaft of the electrode 4 is secured innerly, for example, by point welding.

The vacuum type connection between the supply strand 3 and plug 2 is accomplished by the melted vitreous enamel 5, which due to the capillary forces will easily penetrate between the metal wires of the supply strand. The plug 2 is combined with the tube 1 also by the melted vitreous enamel 6.

In the manufacturing of the discharge tube firstly the tube 1, the plug 2, the supply strand 3 together with the secured electrode and the glass or vitreous enamel 5 and 6 (in the form of previously pressed rings or painted on and dried suspension) are assembled, the end of the tube 1 becomes heated in a vaccum or in a neutral gas atmosphere as long until the vitreous enamel 5 and 6 will melt. The other end of the discharge tube becomes also closed, but previously into the inside of the tube 1 the desired additional material is placed (an alloy of sodium with mercury and/or cadmium) and the sealing-in is performed in an atmosphere which is identical with the fill gas to be used in the discharge tube (for example xenon).

The so called suction pipe-free pumping technology is known per se and used widely.

The finished discharge tube thereafter is mounted in a conventional manner into the vacuum or a neutral filling gas containing outer envelope. Regarding this operation the flexibility of the supply current terminal becomes advantageously useful, since it obviates the need for the insertion of a flexible special element for compensating for the heat expansion of the discharge tube, which itself represents a further advantage of the invention.

The above described embodiment is naturally only a possible realization of our invention, a large number of variations of it are possible and which could meet the set objective. For example, it is possible to employ the supply current terminal according to the present invention in a form to pass it through a single bore of the plug filling the tube end and, make it coaxial with the discharge tube and butt weld it (for example with laser welding) to the similar coaxially located electrode shaft.

It is also possible to produce a special feed through according to the above invention for use it to an auxilarly electrode (and igniting electrode).

Such another structural alternative do not touch upon the basic principles of the invention.

We claim:

1. Electrical feed-through, preferably for high pressure gas discharge light sources, said feed-through is preferably passed through a ceramic material made from aluminum oxide, said feed-through being hermetically bound to said ceramic material with a binding material, preferably vitreous enamel having an appropriately selected heat expansion coefficient, characterized in that the electrical feed-through comprises a bundle of metal threads, wherein said threads are molybdenum or molybdenum alloy or tungsten or tungsten alloy.

2. Electrical feed-through according to claim 1, characterized in that the bundle is manufactured from strands or from braids.

3. The electrical feed-through according to claim 2, characterized in that from two or more strands or braids a secondary strand or secondary braid is made.

4. The electrical feed-through according to claim 1, characterized in that the material of the metallic threads is molybdenum or its alloy.

5. The electrical feed-through according to claim 4, characterized in that the diameter of the metallic threads is less than 0.15 mm.

6. The electrical feed-through according to claim 5, characterized in that the diameter of the metallic threads lies between 0.01 and 0.1 mm.

7. The electrical feed-through according to claim 1, characterized in that the material of the metallic threads is tungsten or its alloy.

8. The electrical feed-through according to claim 7, characterized in that the diameter of the metallic threads is smalller than 0.1 mm.

9. The electrical feed-through according to claim 8, characterized in that the diameter of the metallic threads lies between 0.01 and 0.06 mm.

10. Light source with high pressure gas discharge, which in the outer envelope has placed a discharge tube preferably of ceramic tube made from aluminum oxide and tube enclosure preferably made from aluminum oxide ceramics, comprising at least two electrodes with joined electrical feed throughs, said electrical feed-throughs are hermetically sealed to the tube end closure with a binding material, preferably vitreous enamel, the heat expansion coefficient of said enamel is adjusted to the ceramic material, characterized in that each electrical feed-through comprises a bundle of metallic threads, wherein said threads are molybdenum or molybdenum alloy or tungsten or tungsten alloy.

* * * * *